US007950078B2

(12) United States Patent
Houpt

(10) Patent No.: US 7,950,078 B2
(45) Date of Patent: May 31, 2011

(54) PREFORMED STRUCTURAL SUPPORT FOR TILE

(76) Inventor: Robin Houpt, Crystal River, FL (US)

( * ) Notice: Subject to any disclaimer, the term of this patent is extended or adjusted under 35 U.S.C. 154(b) by 980 days.

(21) Appl. No.: 11/781,662

(22) Filed: Jul. 23, 2007

(65) Prior Publication Data

US 2009/0025139 A1 Jan. 29, 2009

(51) Int. Cl.
*A47K 4/00* (2006.01)

(52) U.S. Cl. ..... 4/578.1; 4/611; 4/574.1

(58) Field of Classification Search ..... 4/574.1, 4/578.1, 589, 590, 611, 612
See application file for complete search history.

(56) References Cited

U.S. PATENT DOCUMENTS 3,640,041 A 2/1972 Michieli
4,771,488 A 9/1988 Markham
5,341,528 A 8/1994 Sultzbaugh
5,542,218 A 8/1996 Rompel
5,732,421 A 3/1998 Scherberger
6,052,845 A 4/2000 Harvey
6,301,725 B1 10/2001 Harvey
6,662,513 B2 12/2003 Rodlin
7,673,420 B2 * 3/2010 Madesh ..... 52/34

OTHER PUBLICATIONS

T. Clear Corporation, PreFormed Tile Ready Shower Seat. http://www.finpan.com/utilacrete/c.pdf.

* cited by examiner

*Primary Examiner* — Huyen Le

(57) ABSTRACT

A preformed structural support for ceramic tile for use in constructing a horizontal support surface, such as a seat or a foot rest in a shower or the like installation environment is provided. The preformed structural support includes a base of a corrosion-resistant material that can be trimmed to conform to the irregularities of the structural walls to which it is to be installed against. The base includes tile receiving sides that are textured and are ready for the application of tile using a suitable adhesive, such as a thinset compound. The preformed structural support is installed without the use of penetrating fasteners, thereby preserving the integrity of the waterproofing of the shower.

13 Claims, 8 Drawing Sheets

PREFORMED STRUCTURAL SUPPORT FOR TILE

TECHNICAL FIELD

The present disclosure relates generally to seats and shelves used in showers, baths and the like, and more particularly, relating to a preformed structural support for use in the construction of seats for new and existing ceramic tile surfaces where the preformed structural support is site customizable to conform to the irregularities of the shower or bath wall structure.

BACKGROUND

Seats and shelves are desired fixtures in showers, baths and the like for providing architectural decoration, a place for sitting, a foot rest or a horizontal surface to store bathing related articles. In constructing such fixtures, it is important to preserve the waterproofing of the bath or shower, provide an appealing finished product, and also ensure the fixture can support loading, such as, for example, when a person sits or uses the fixture as a foot rest.

One usual method of constructing these fixtures includes a site-built wood frame structure that is attached to the rough frame of a shower or tub wall and/or floor. The wood frame structure is then waterproofed with one of several methods and then reinforced with expanded metal, wire mesh or other means. A sub-base or mortar is applied to all of the exposed surface areas, and then tile is placed over the mortar by means of a suitable bonding agent, such as thinset. Although this provides an appealing finished look it is problematic and has many draw backs. First, the construction method is very labor intensive, time consuming and requires a degree of skill that most general construction labors do not have. Further, if the waterproofing is not done correctly or is compromised the construction is prone to failure due to water penetration. Water damage in this area can lead to extensive repair costs. Further yet, the wood frame is likely to shrink and the wood frame members are likely to shift overtime resulting in cracking of the tile and grout finish and damaging the waterproofing.

A second usual method of constructing these fixtures includes building a support structure of concrete blocks during either the rough-in of the bath or shower or after waterproofing the bath or shower construction. The concrete blocks are individually arranged to form a perimeter wall that is then filled with concrete or a mortar mix to form a top horizontal surface. The surface of the concrete blocks and top horizontal surface are prepared for the application of tile using the typical various methods. Although this method attempt to eliminate the shrinking and shifting of the wood members experienced by the first method, this method also has many drawbacks. In this regard, it is more labor intensive, results in a heavier construction, and requires additional skills even over the first method.

One attempt to provide a better construction method and device for constructing such fixtures in showers and baths is disclosed in U.S. Pat. No. 5,542,218 ("the '218 patent"), issued to Rompel on Aug. 6, 1996. The '218 patent describes a corrosion-resistant self-supported frame of a pre-form shape, to which a mortar substrate and ceramic tile is applied, in order to produce corner seats and trays.

While the pre-form of the '218 patent provides a ready made support structure for use in constructing corner seats and trays in showers or baths it requires the use of penetrating fasteners, such as, a threaded fastener to attach the pre-form to the shower or bath wall framing members, which requires penetrating the waterproofing of the shower or bath. Any penetration of the waterproofing can lead to water damage resulting in costly repairs. Additionally, the pre-form may not be capable of conforming to irregularities of the shower or bath walls. It is very common for abutting vertical walls in a building structure, such as, a bath or shower to not be perfectly square or plumb. The addition of surface tile can further add or exaggerate the wall irregularities. The pre-form of the '218 patent is constructed with the expectation of the walls being square and plumb. However, if this is not the case during installation, gaps can result between the pre-form and the walls or the pre-form can be damaged by over tightening of the penetrating fasteners in attempt to close the gaps, either of which is likely to result in failure. An additional possible drawback of the pre-form of the '218 patent, is the pre-form is designed to be elevated above the floor of the bath or shower and installed in a cantilever fashion. In some installations, it is desirable to have the seat extend down to the floor of the bath or shower, and the pre-form of the '218 is not capable of providing this.

An additional attempt to provide a better construction method and device for constructing such fixtures in showers and baths is provided by T. Clear Corp. in their PreFormed™ tile ready shower seat which is lightweight, does not require wood framing and its installation does not compromise the waterproofing of the shower or bath. However, T. Clear Corp. instructs the walls to which the seat is to be installed against must be square and plumb and you must not cut the seat or otherwise damage the exterior coating of the seat. These requirements makes utilization of the seat less practical as most walls are not square or plumb and the seat can not be cut to conform to the irregularities of the walls. Further, it is likely during the tiling process tools or tiles will be dropped, and in this event, if the tools or tile impact the seat this may damage the exterior coating requiring costly replacement of the seat.

The disclosed preformed structural support for use in the construction of seats for new and existing ceramic tile surfaces is directed to overcoming one or more of the problems set forth above and other problems present in the art.

SUMMARY OF THE INVENTION

In general, in one aspect, a preformed structural support for ceramic tile for use in constructing a horizontal support surface, such as a seat or a foot rest in a shower or the like installation environment having structural surfaces for attachment of the preformed structural support thereto is provided. The preformed structural support includes a base unit having a plurality of inward facing sides, and plurality of outward facing sides, wherein at least one of the plurality of inward facing sides includes a lip at least partially around and projecting from the periphery thereof. Each lip having an interface surface for abutment with at least one structural surface, and wherein each of the plurality of outward facing sides is adapted for the application of tile thereon.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters denote corresponding features consistently throughout the attached drawings.

DETAILED DESCRIPTION OF THE INVENTION

Figure 1:
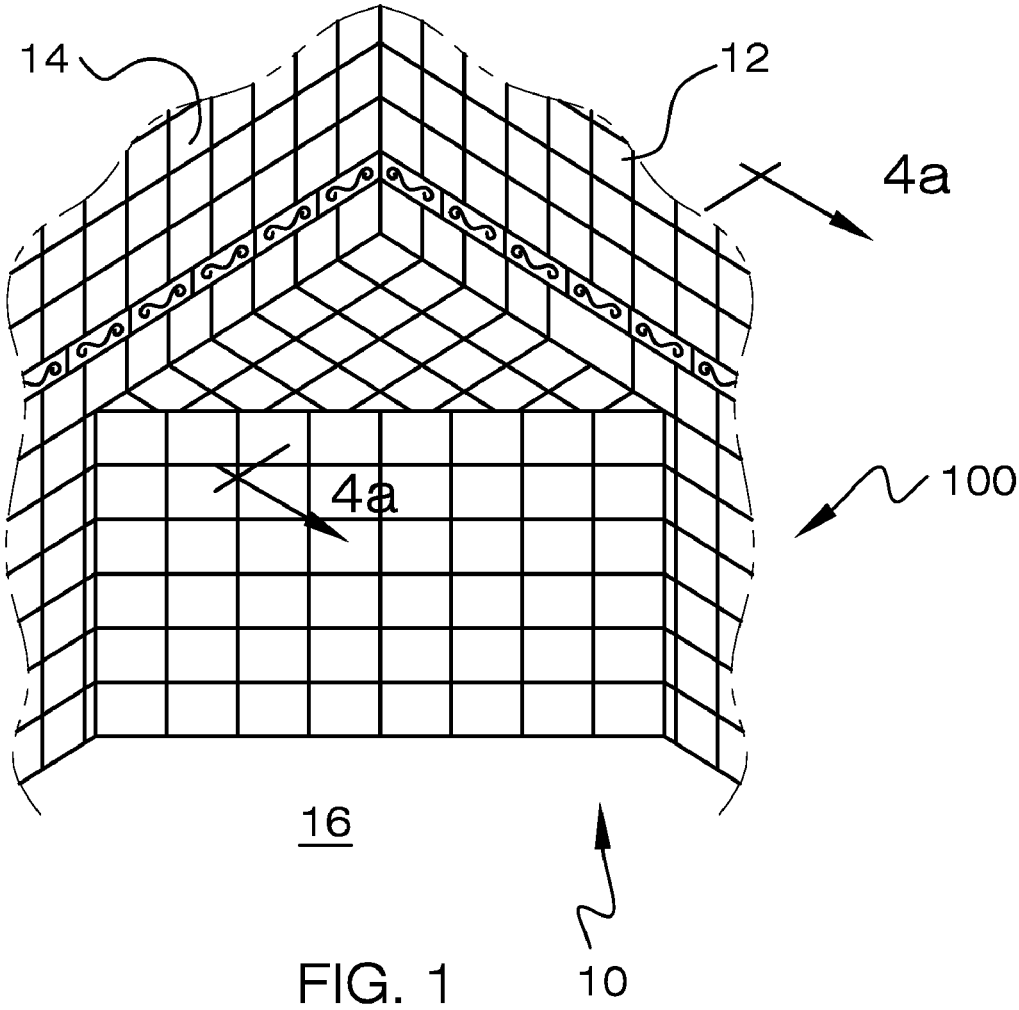
FIG. 1 is a front perspective view of the preformed structural support shown installed in a typical installation environment, such as a shower.

With reference to FIG. 1 of the drawings, there is shown a perspective view of a preformed structural support 10 for use in the construction of seats for new and existing ceramic tile surfaces constructed in accordance with the principals of the present invention installed in a typical installation environment 100 such as a shower or bath. The preformed structural support 10 is positioned in a corner formed by two vertical walls 12 and 14 and a horizontal floor surface 16, herein referred to as structural surfaces.

Figure 2:
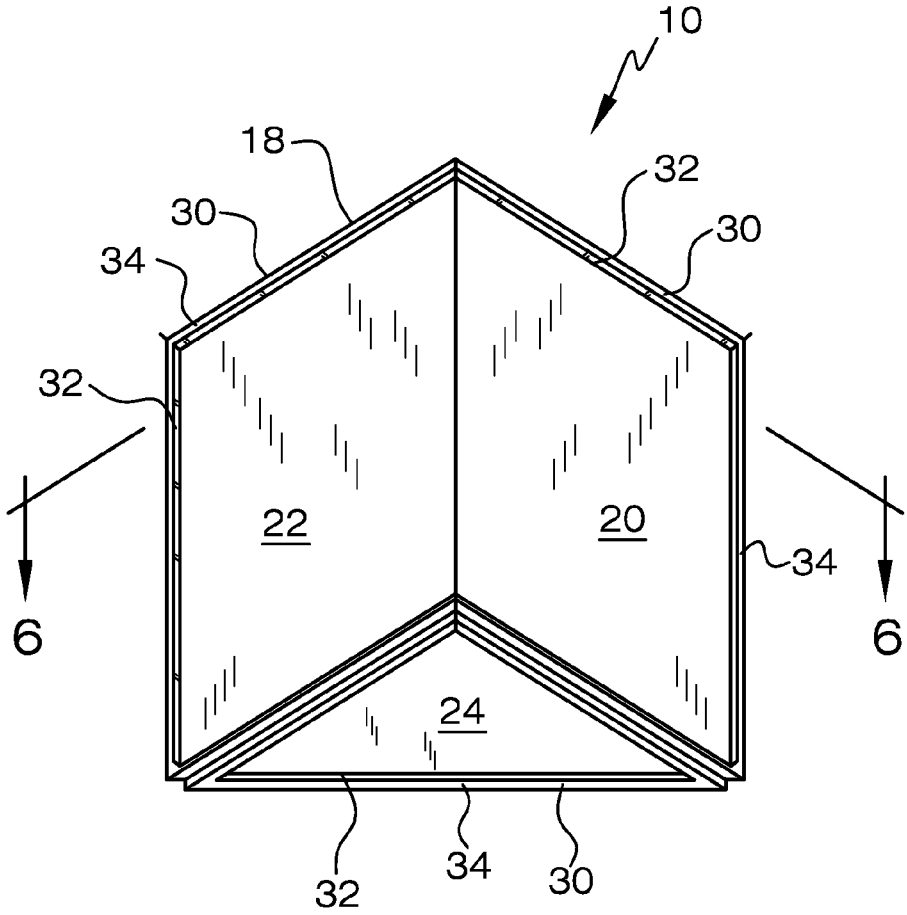
FIG. 2 is a rear perspective view of the preformed structural support constructed under the principals of the present invention.
Figure 3:
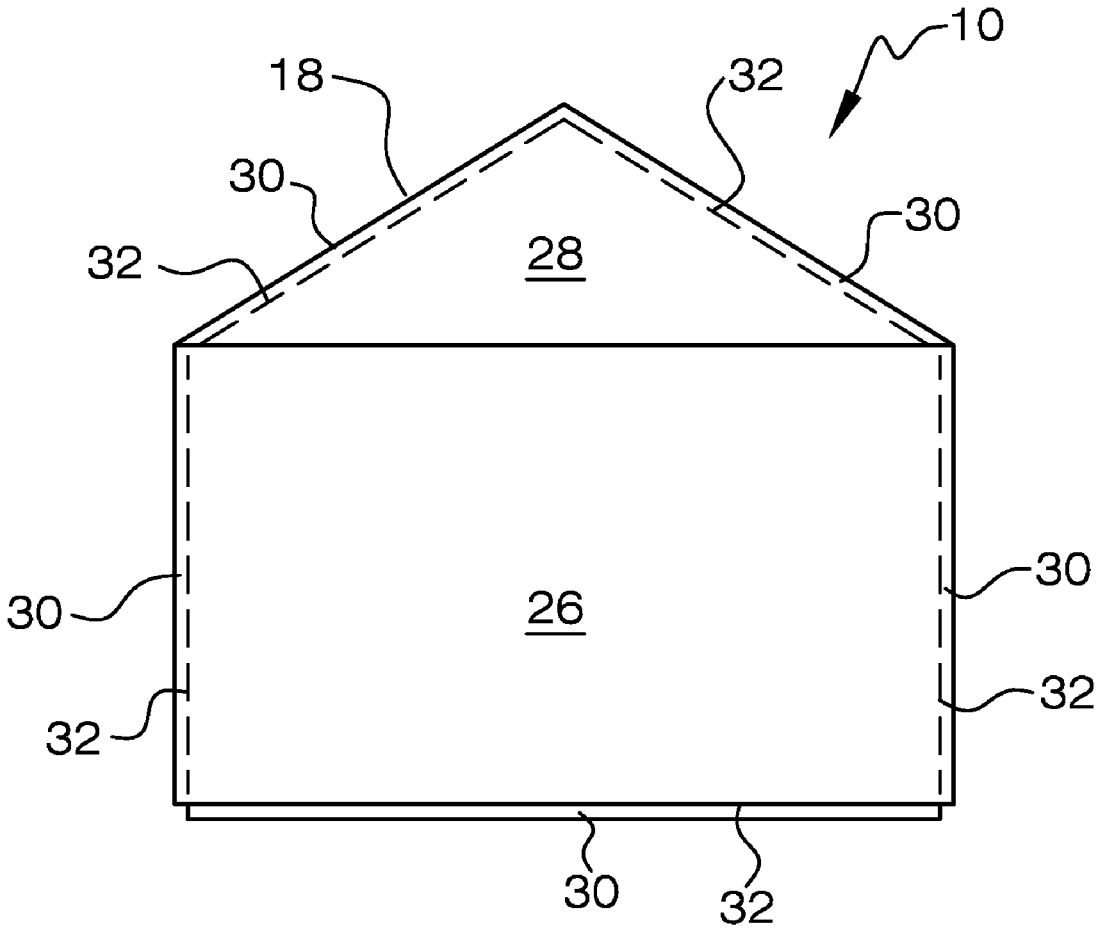
FIG. 3 is a front perspective view of the preformed structural support constructed under the principals of the present invention.

With reference now to FIGS. 1-3, the preformed structural support 10 includes a base unit 18 of a desired size and shape constructed of a non-corrosive, rigid material. It is contemplated the base unit 18 being constructed of a plastic through injection molding or otherwise. It is further contemplated, the base unit 18 being constructed of a high-density plastic. A suitable high-density plastic may be ABS. The plastic material also may include a reinforcement material. A suitable reinforcement material may be a fibrous material, such as, for example, glass or carbon fibers.

The base unit 18, with reference to the installation positioning, includes a plurality of inward facing sides 20-24 and a plurality of outward facing sides 26 and 28. The base unit 18 is generally constructed to have a polygonal horizontal cross-sectional shape with two opposed and attitudinally spaced horizontal surfaces and a number of vertical surfaces equal to the number of sides of the polygon extending between the two horizontal surfaces. The desired installation position of the base unit 18 with respect to the installation environment's structural surfaces determines the number of inward facing sides and the number of outward facing sides. In one aspect, the base unit 18 includes at least one inward facing side and at least one outward facing side. In another aspect, the base unit 18 includes at least two inward facing sides and at least two outward facing sides. As illustrated, the base unit 18 includes two vertical inward facing sides 20, 22 and a horizontal side inward facing side 24, and a vertical outward facing side 26 and a horizontal outward facing side 28. The inward facing sides 20-24 may be continuous surfaces. The outward facing sides 26, 28 may be continuous surfaces.

A lip 30 extends at least partially around the periphery 32 of each inward facing side 20-24. The lip 30 may extend from at least two peripheral edges of each inward facing side 20-24. The lip 30 may extend from at least three contiguous peripheral edges of each inward facing side 20-24. Each lip 30 includes an interface surface 34 for abutting with a structural surface of the installation environment 100, which will be further explain in more detail below. The lip 30 may extend from the periphery 32 of its respective inward facing side 20-24 such that the interface surface 34 is at a spaced distance from the inward facing side. The 30 may extending from the periphery 32 of its respective inward facing side 20-24 such that the interface surface 34 is at a spaced distance from and generally parallel to the inward facing side. In one aspect, the lip 30 extends about 0.5 inches from the periphery 30 of its respective inward facing side 20-24. In another aspect, the lip 30 extends less than about 0.5 inches from the periphery 30 of its respective inward facing side 20-24. In another aspect, the lip 30 extends about 0.5 inches from the periphery 30 of its respective inward facing side 20-24 and if of a thickness of about 0.5 inches. In another aspect, the lip 30 extends less than about 0.5 inches from the periphery 30 of its respective inward facing side 20-24 and is of a thickness of about or less than 0.5 inches.

The lips 30 can be trimmed to conform to the irregularities and/or angles of the structural surfaces in relation to the adjacent structural surfaces to which the base unit 18 is to be installed against. For example, very often, the corner formed by two vertical walls abutting one another is rarely perfectly square forming, thus forming a ninety degree angle. Additionally, the floor surface of the installation environment is typically formed to have a slight slant towards a drain formed through the floor. In either of these events, it is impractical to first measure these angles and then request a manufacture to construct and ship a pre-formed seat structure having interface surfaces formed to match the measured angles. As such, being able to trim the lips 30 permits on-site customization of the base unit 18 to fit the intersections of the abutting structural surfaces, the irregularities of the structural surfaces and the angles of the structural surfaces.

Figure 4A:
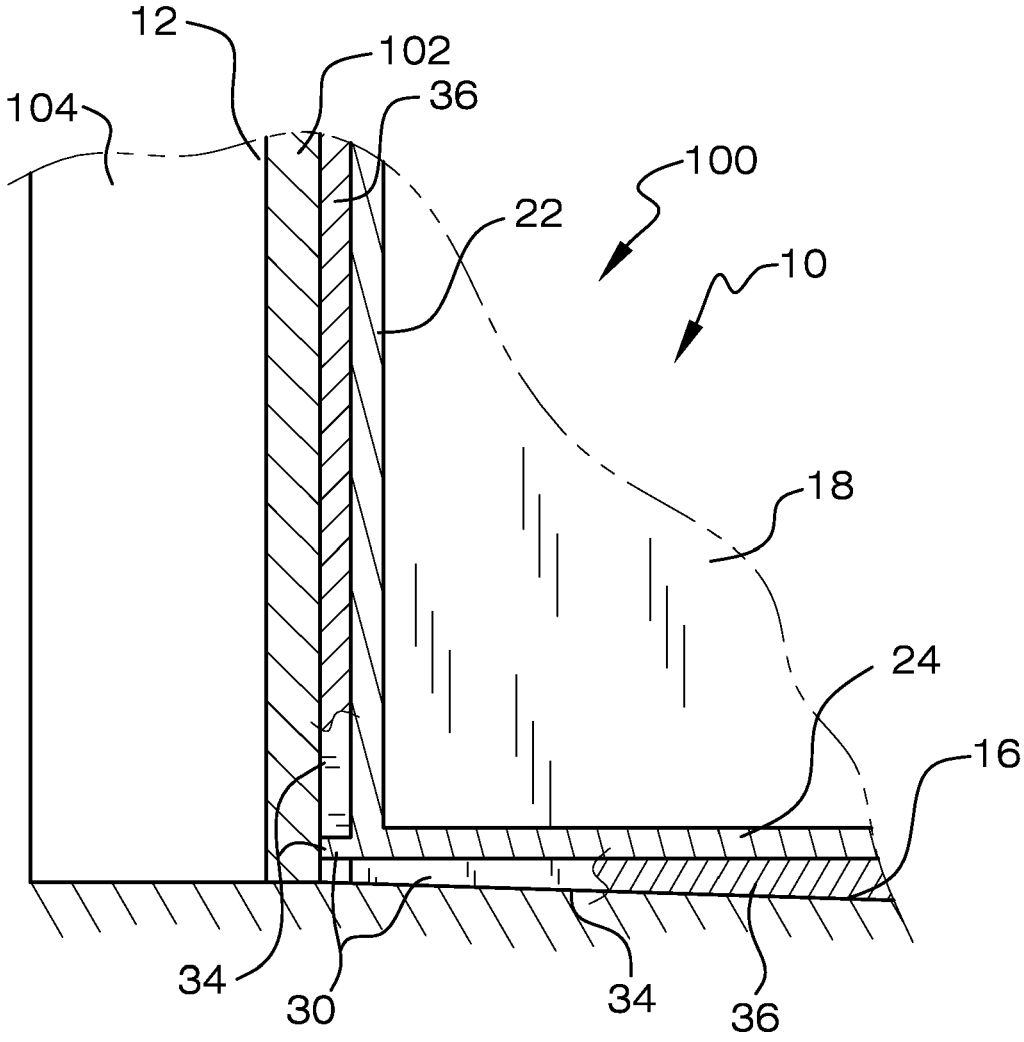
FIG. 4*a* is a partial cross-sectional view taken along line 4*a*-4*a* in FIG. 3 showing the preformed structure support is shown installed as "new construction"
Figure 4B:
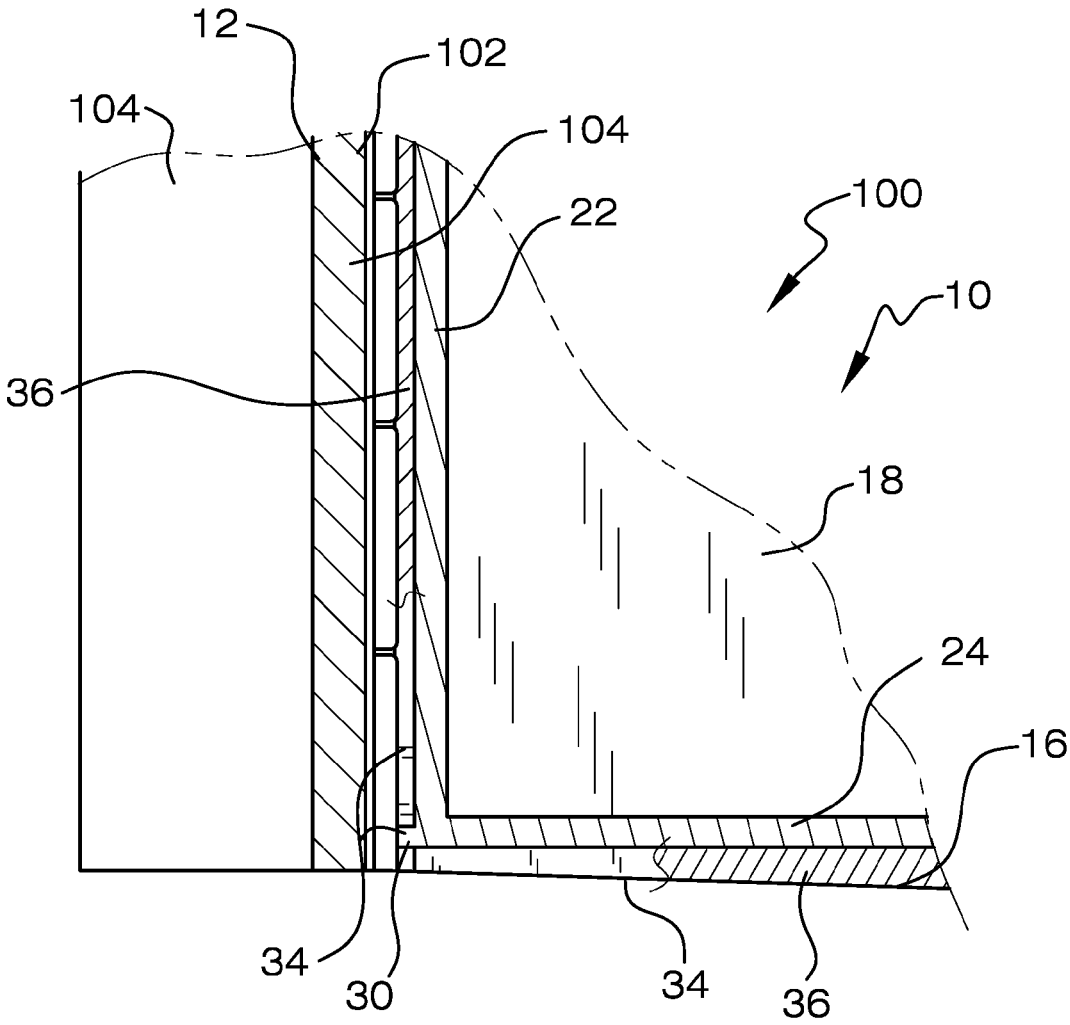
FIG. 4*b* is a variation of FIG. 4*b*, where the preformed structural support is shown installed as "old construction"

The preformed structural support 10 can be installed as "new construction" meaning before the application of tile to the structural surfaces to which the base 18 is to be installed, as shown in FIG. 4*a*, or "old construction" meaning after application of tile to the structural surfaces as shown in FIG. 4*b*.

With particular reference to FIG. 4*a*, there is shown a partial, elevation sectional view of the preformed structural support 10 as shown in FIG. 1. While the below discussion is made in reference to only one vertical inward facing side, the same applies to the remaining vertical inward facing sides. The base 18 is installed with the vertical inward facing side 22 against a structural vertical wall or structural surface 12 and the horizontal inward facing surface 24 against the floor or structural surface 16 of the installation environment 100. The base 18 is showing being installed as "new" construction meaning before the application of tiles to the structural surfaces. The vertical wall 12 includes a waterproofed outer surface 102 supported by wall framing 104. The floor 16 is waterproofed and is a sub-base of the shower or bath. The interface surfaces 34 of the lips 30 of the inward facing sides 22 and 24 are shown trimmed and in contact with the surface 102 and floor 16 respectively. Note, the lip 30 of the inward facing side 24 has been trimmed to conform to the slight slope of the floor 16 ensuring a continuous contact between the interface surface 34 and the floor. A suitable adhesive 36 (partially cutaway to illustrate lips) is applied between the structural surfaces 102 and 16, the inward facing sides 22 and 24, and the interface surfaces 34 to secure the base 18 to the structural surfaces. A suitable adhesive may be a mortar mix or the like. Another suitable adhesive may be a single or multipart epoxy compound. The use of an adhesive as opposed to mechanical fasteners insures the integrity of the waterproofing of the structural surfaces.

With reference to FIG. 4*b*, the base 18 is showing being installed as "old" construction meaning after the application of tiles to the structural surfaces. Like above, vertical wall 12 includes a waterproofed outer surface 102 supported by wall framing 104 and additionally includes a layer of tiles 104. The floor 16 is waterproofed and is a sub-base of the shower or bath. While not shown, the floor 16 could also have a layer of tiles. The interface surfaces 34 of the lips 30 of the inward facing sides 22 and 24 are shown trimmed and in contact with the layer of tiles 104 and floor 16 respectively. Note, the lip 30 of the inward facing side 24 has been trimmed to conform to the slight slope of the floor 16 ensuring a continuous contact between the interface surface 34 and the floor. A suitable adhesive 36 (partially cutaway to illustrate lips) is applied between the structural tile layer 104 and 16, the inward facing sides 22 and 24, and the interface surfaces 34 to secure the base 18 to the structural surfaces. A suitable adhesive may be a mortar mix or the like. Another suitable adhesive may be a single or multipart epoxy compound. The use of an adhesive as opposed to mechanical fasteners eliminates the need to penetrate the structural surfaces and insures the integrity of the waterproofing of the structural surfaces and prevents the requirement of drilling through the tile layer 104.

Figure 5:
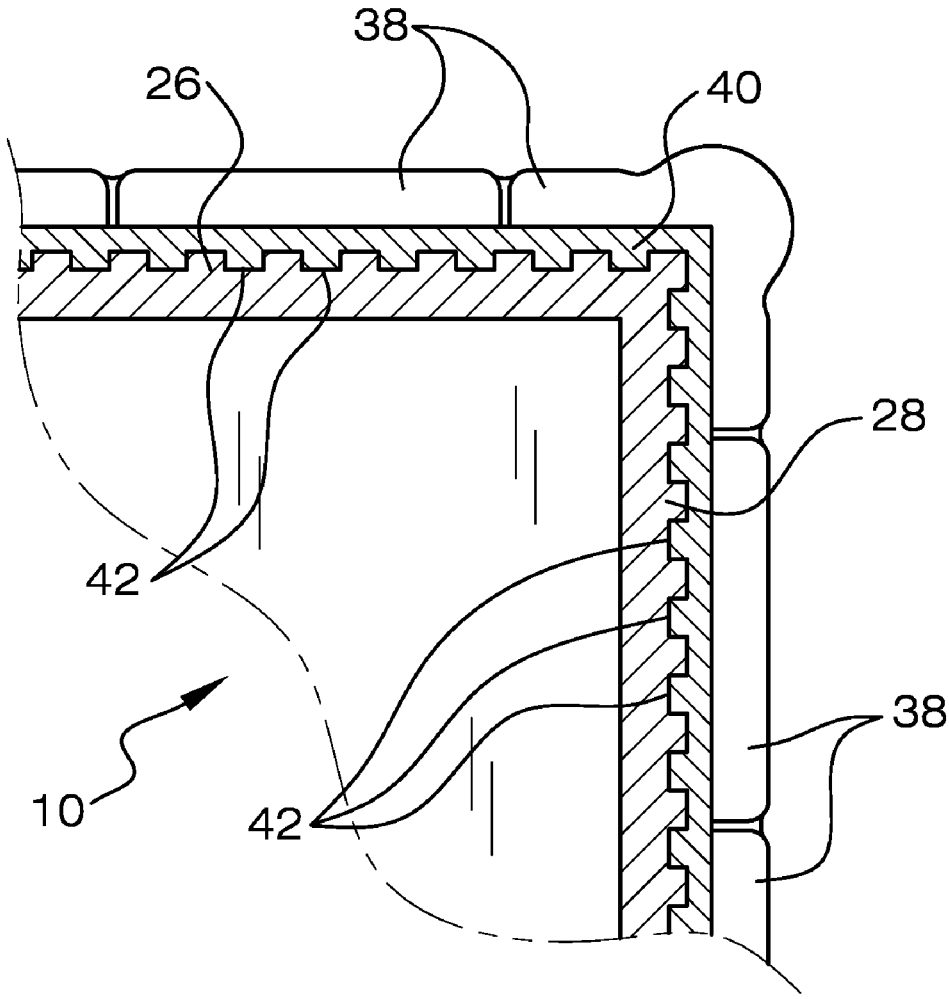
FIG. 5 is a partial cross-sectional view of two outward facing sides with tile applied to the sides.

With reference to FIG. 5, there is shown a partial cross-sectional view of base unit 18 with a plurality of tiles 38 applied to the outward facing surface 26, 28. The outward facing sides 26, 28 may be textured or otherwise treated to permit the direct application of tile 38 with a suitable adhesive 40 to the outward facing sides. A suitable adhesive 40 for attaching tile 38 to the outward facing sides 26, 28 may be a thinset compound. In one aspect, the outward facing sides 26, 28 may have a plurality of recessed pockets 42. The pockets 42 capture and retain the adhesive 40 for application of the tile 38. The pockets 42 can be arranged in desired patterns on the outward facing sides 26, 28.

Figure 6:
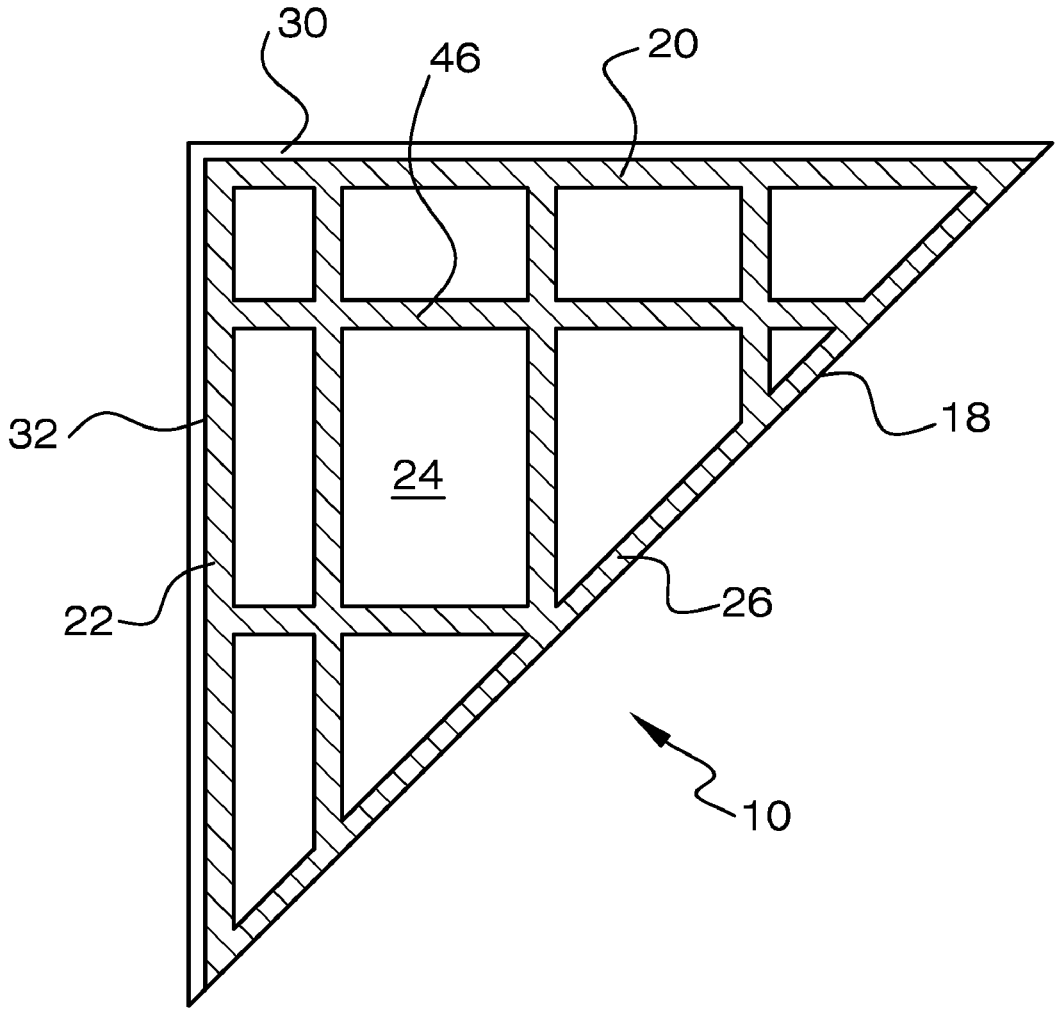
FIG. 6 is a cross-sectional view taken along line 6-6 in FIG. 2 showing a hollow interior configuration of the preformed structural support with internal reinforcement.

Turning now FIG. 6, which is a horizontal cross sectional view of the base unit 18, to reduce weight and manufacturing costs, the base unit may be constructed to have a hollow interior 44 that is defined by the sides 20-28. An internal reinforcement 46 may be provided to support the sides of the base. In one aspect, the internal reinforcement 46 is provided in the form webbing that extends across the vertical sides 20, 22, 26 between the horizontal sides 24, 28. The webbing 46 may be formed into any desired pattern that affords the most structural support while reducing weight and manufacture costs. In one aspect, as shown, the webbing 46 is generally rectangular. In another aspect, the webbing 46 may be honeycomb shaped.

Figure 7A:
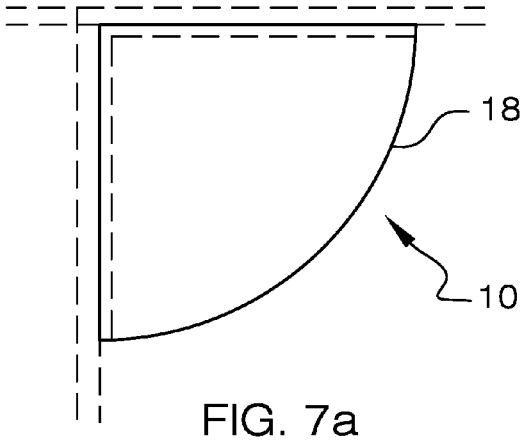
FIG. 7*a* is a top plan view of the preformed structural support with an alternate configuration.
Figure 7B:
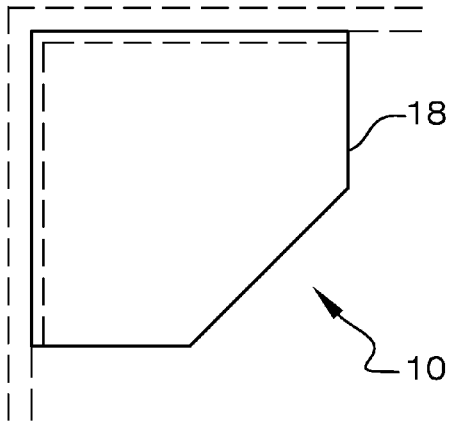
FIG. 7*b* is a top plan view of the preformed structural support with an alternate configuration.
Figure 7C:
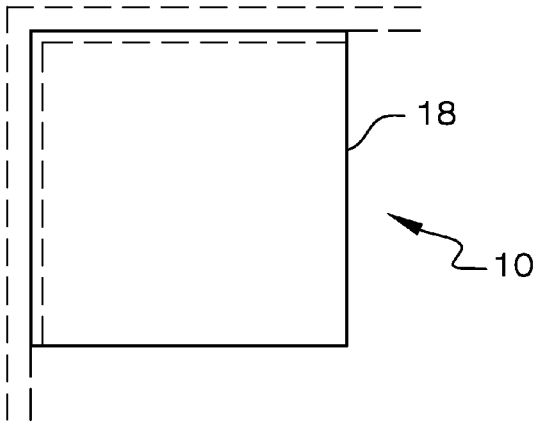
FIG. 7*c* is a top plan view of the preformed structural support with an alternate configuration.

While the above description of the preformed structural support 10 was made in reference to a base unit 18 having a triangular horizontal cross-sectional shape, the base unit 18 is generally constructed to have a polygonal horizontal cross-sectional shape with two opposed and attitudinally spaced horizontal surfaces and a number of vertical surfaces equal to the number of sides of the polygon extending between the two horizontal surfaces. For example, with reference to FIGS. 7*a*, 7*b* and 7*c*, the base unit 18 is shown of various different shapes. In FIG. 7*a*, the base unit 18 has a polygonal shape generally of a quarter circle and includes two horizontal sides (one not shown) and three vertical sides. In FIG. 7*b*, the base unit 18 has a polygonal shape generally of a truncated square, and includes two horizontal sides and five vertical sides. Likewise, in FIG. 7*c*, the base unit 18 has a polygonal shape generally of a square, and includes two horizontal sides and four vertical sides. The shape of the base unit 18 of the preformed structural support 10 should not be limited to the examples discussed herein, as the base unit may be constructed to have numerous shapes.

In use, the preformed structural support 10 is first dry fit to the structural walls to which it is to be attached, including any vertical walls and floor. The lip 30 of each inward facing side is trimmed by a plane, saw, knife or otherwise so as to shape the interface surface 34 thereof to conform to the irregularities and angles of the respective wall/floor. The lips 30 are trimmed also to ensure each interface surface 34 makes even contact with the surrounds walls/floor so the base unit 18 does not rock. Once the preformed structural support 10 is dry fit, a suitable adhesive is applied to the inward facing sides and interface surfaces and the base unit 18 is set into place. Once the adhesive is cured, tile is applied to the outward facing surfaces using known methods.

A number of embodiments of the present invention have been described. Nevertheless, it will be understood that various modifications may be made without departing from the spirit and scope of the invention. Accordingly, other embodiments are within the scope of the following claims.

I claim:

1. A preformed structural support for ceramic tile for use in constructing a horizontal support surface, such as a seat or a foot rest in a shower or the like installation environment having structural surfaces for attachment of the preformed structural support thereto, the preformed structural support comprising in combination:

a base unit having a plurality of inward facing sides, and plurality of outward facing sides;

wherein at least one of said plurality of inward facing sides includes a lip at least partially around and projecting from the periphery thereof, each lip having an interface surface for abutment with at least one structural surface; and wherein each of said plurality of outward facing sides is adapted for the application of tile thereon.

2. The preformed structural support of claim 1, wherein said lip is formed such that its interface surface is generally parallel to and spaced from the respective and corresponding inward facing side.

3. The preformed structural support of claim 2, wherein each lip is around the periphery of its respective and corresponding inward facing side along at least three contiguous edges thereof.

4. The preformed structural support of claim 1, wherein of said plurality of inward facing sides, there is included at least two vertical inward facing sides and at least one horizontal inward facing side; and wherein of said plurality of outward facing sides, there is included at least one vertical outward facing side and at least one horizontal outward facing side.

5. The preformed structural support of claim 1, wherein each of said plurality of outward facing sides is a continuous surface and is textured.

6. The preformed structural support of claim 5, wherein said texture is provided by a plurality of geometrical recesses arranged in a determined pattern and formed into each of said plurality outward facing sides.

7. The preformed structural support of claim 1, wherein said base unit is of a honey comb construction.

8. The preformed structural support of claim 1, wherein said base includes support webbing extending between at least two sides of either said plurality of inward facing sides or said plurality of outward facing sides.

9. A preformed structural support for ceramic tile for use in constructing a horizontal support surface, such as a seat or a foot rest in a shower or the like installation environment having structural surfaces for attachment of the preformed structural support thereto, the preformed structural support comprising in combination:

a base unit having a polygonal horizontal cross-section having two opposed and attitudinally spaced horizontal sides and a number of vertical sides equal to the number of sides of the polygonal shape, one of said horizontal sides being an inwardly facing side and the other being an outwardly facing side, at least two of said vertical sides being inward facing sides with the remaining of said vertical sides being outward facing sides;

wherein at least one of said inward facing sides includes a lip at least partially around and projecting from the periphery thereof, the lip having an interface surface for abutment with at least one structural surface; and wherein each of said of outward facing sides is adapted for the application of tile thereon.

10. The preformed structural support of claim 9, wherein each of said inward facing sides included said lip.

11. The preformed structural support of claim 9, wherein said lip is formed such that its interface surface is generally parallel to and spaced from the respective and corresponding inward facing side.

12. The preformed structural support of claim 9, wherein each of said outward facing sides is a continuous surface and is textured.

13. The preformed structural support of claim 12, wherein said texture is provided by a plurality of geometrical recesses arranged in a determined pattern and formed into each of said outward facing sides.

* * * * *